United States Patent [19]

Hendricks

[11] 3,965,492

[45] June 29, 1976

[54] ELECTRIC FLUSHING TOILET BOWL

[76] Inventor: Victor P. Hendricks, c/o G. F. Gibbs, 1850 Bel-Aire Road, Los Angeles, Calif. 90024

[22] Filed: Aug. 12, 1974

[21] Appl. No.: 496,520

[52] U.S. Cl. ..... 4/79; 4/84; 4/DIG. 3; 137/624.11

[51] Int. Cl.[2] ..... E03D 5/012

[58] Field of Search ..... 4/10, 26, 30, 31, 33, 4/38, 41, 57 R, 67 R, 76, 79, 80, 84, 100, 248, 249, DIG. 3, DIG. 13; 137/624.11

[56] References Cited

UNITED STATES PATENTS

| | | | |
|---|---|---|---|
| 1,985,314 | 12/1934 | Coleman | 4/101 |
| 3,079,612 | 3/1963 | Corliss | 4/10 |
| 3,302,216 | 2/1967 | Fulton et al. | 4/10 X |
| 3,308,481 | 3/1967 | O'Brien et al. | 4/79 |
| 3,683,964 | 8/1972 | Harrold | 137/624.11 |

*Primary Examiner*—Richard E. Aegerter
*Assistant Examiner*—Stuart S. Levy
*Attorney, Agent, or Firm*—Whann & McManigal

[57] ABSTRACT

A self-contained electric flushing toilet bowl in which water for flushing the bowl is automatically controlled by unique control mechanism to perform a series of cyclic operations in which the supply water to the bowl and outlet flow from the bowl will be so coordinated as to impound a volume of water in the bowl at a raised water level for use in flushing and cleaning the bowl, the control mechanism being housed in an accessible rear compartment of the bowl structure. Outlet flow from the bowl is controlled by means of a valve structure embodied in a line trap of elastomeric material connected to the bowl outlet.

8 Claims, 2 Drawing Figures

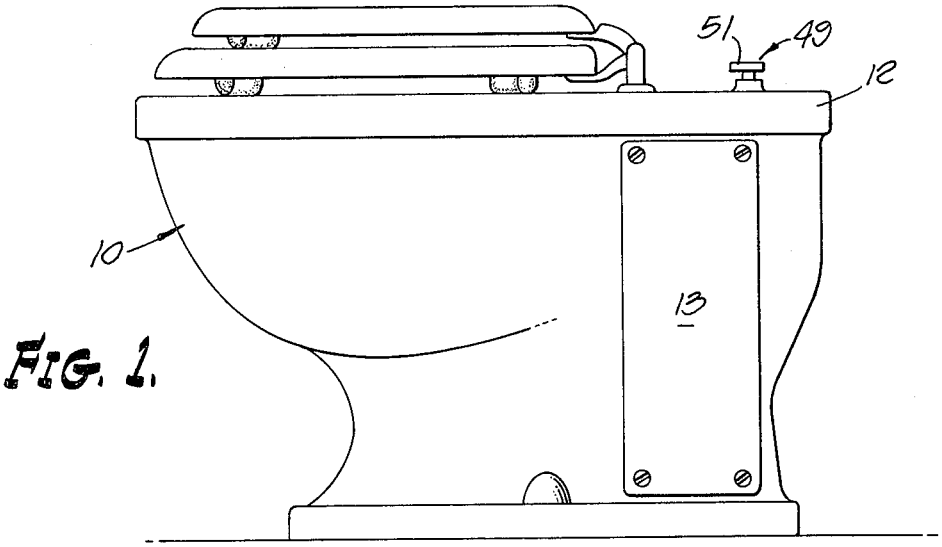
FIG. 1.
FIG. 2.
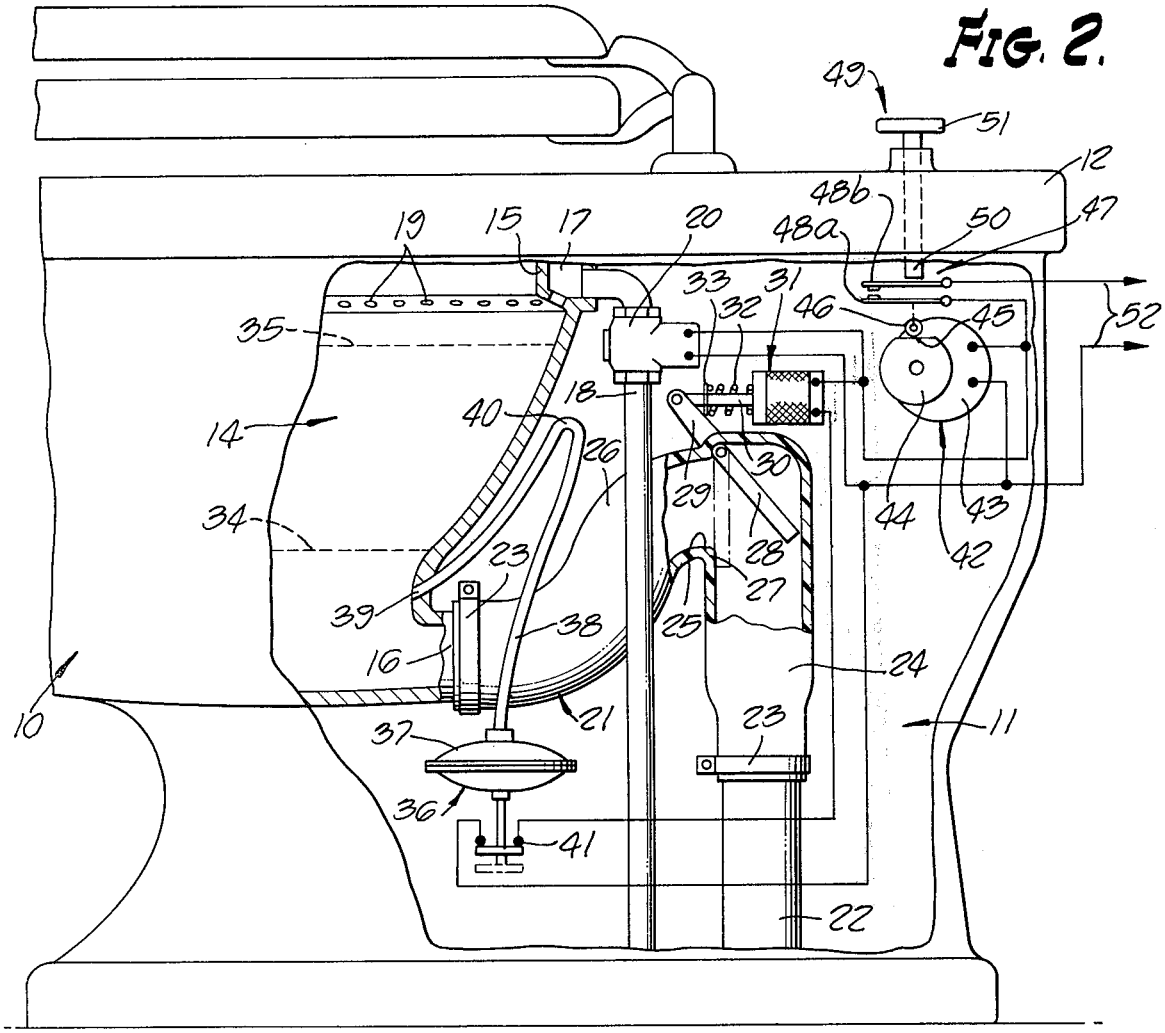

ELECTRIC FLUSHING TOILET BOWL

PRIOR ART

In the prior art there are a number of flushing systems for urinals and toilet bowls which utilize timing means for actuating a flushing valve, the water for flushing being provided from a supply source. The closest art known to applicant is the following U.S. Pat. Nos.:

1,978,737 — Oct. 30, 1934
1,985,314 — Dec. 25, 1934
2,999,191 — Sept. 5, 1961
3,029,443 — Apr. 7, 1962
3,034,151 — May 15, 1962
3,056,143 — Oct. 2, 1962
3,060,450 — Oct. 30, 1962
3,090,967 — May 28, 1963

BACKGROUND OF THE INVENTION

The present invention relates generally to the field of flush type toilet bowls.

Heretofore, it has been generally known to provide toilet bowls of the flushing type in which flushing water is admitted to the bowl through a flushing control valve from either an associated separate tank or from a directly connected large flow water pressure line. It has also been known to provide in some arrangements an electrical actuator for the flush valve, which could be energized at any desired time to effect a flushing operation. In other arrangements, it has been known to provide an associated timing means to automatically effect actuation of the flushing valve at periodic intervals.

The present invention differs from the heretofore known arrangements in that instead of utilizing a separate tank, the toilet bowl is utilized as a receptacle for the impoundment of a volume of water at a raised level for use in the flushing operation, and in the provision of a manually initiated automatic flushing control, including electric timing means, energizable to effect a cycle of sequential operation; e.g., 1. to open a water admitting valve and close a bowl outlet valve to provide a raised fluid level in the bowl,
2. to open the outlet valve so as to utilize the water at the raised level in the bowl for flushing the bowl, and
3. after a time interval to close the water admitting valve.

SUMMARY OF THE INVENTION

The present invention relates generally to a flushing toilet, and is more particularly concerned with a self-contained electric toilet having unique means for automatically impounding a volume of flushing water in the toilet bowl, and releasing the impounded water to flush the bowl, and further provide a flow of water into the bowl for cleaning purposes.

It is one object of the herein described invention to provide a self-contained unique electric flushing toilet bowl.

A further object is to provide an electric flushing toilet bowl according to the foregoing object, wherein the toilet bowl provides a receptacle for the impoundment of a volume of water to be used in the flushing operation.

Another object is to provide an electric flushing toilet having an outlet connection containing a unique line trap of elastomeric material, the trap embodying a built-in electrically operable valve.

Still another object is to provide in an electric flushing toilet, means operable to supply and impound a predetermined volume of water in the toilet bowl for flushing use, and wherein the volume of water is determined in response to an increased level of water in the bowl.

It is also an object of the invention to provide unique electric flushing control for a toilet bowl in which a manually initiated timing mechanism is operable to automatically effect a sequence of operations in which a predetermined volume of water is first impounded in the toilet bowl, and then released for flushing purposes, and thereafter for an interval of time supply water to the bowl for cleaning purposes.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 1 is a side elevational view of an electric flushing toilet bowl embodying the features of the present invention; and FIG. 2 is an enlarged fragmentary side elevation of the same, portions being cut away to disclose the rear compartment and the automatic flushing mechanism therein.

DESCRIPTION OF A PREFERRED EMBODIMENT

For illustrative purposes, there is disclosed in FIG. 1 a toilet bowl 10 of the floor mounted type, the bowl being constructed with a rear compartment 11 which is closed at its top by wall structure 12 in the form of a rear shelf at the level of the toilet bowl rim. The rear compartment 11 is accessible through a removable panel closure 13.

As best shown in FIG. 2, the toilet bowl is of conventional construction and is formed to provide a waste-receiving receptacle 14 having a top rim opening 15 and a bottom outlet connection 16. The top rim opening is surrounded by a circumferentially extending channel 17, this channel having an inlet water supply connection 18 and a plurality of outlet flow openings 19 for the distribution of flushing and cleaning water into the bowl.

The flushing control mechanism of the present invention is housed within the rear compartment 11, and comprises a plurality of cooperatively associated components as will now be described. A first valve 20 is mounted in the water supply connection 18 and is operable to control the flow of water into the channel 17. This valve is of the electric type and is arranged to be normally urged to a closed position, and when electrically energized will be actuated to an open position.

The bottom outlet connection 16 is connected with one end of a line trap 21 of elastomeric material, the other end of the trap being connected with the usual drain line as indicated at 22. The trap connections are effected by suitable clamping members 23, 23.

The trap is in general of inverted U-shaped configuration with the respective end portions terminating in substantially right-angled relationship. One leg, as identified by the numeral 24, is substantially vertical, and at its uppermost end communicates through an opening 25 with the other leg 26 of the trap. The peripheral wall of the opening 25 is formed to provide a valve seating surface 27 which is operatively associated with a swingable valve member 28 in the down stream leg of the trap to form a second valve structure. An external actuating arm 29 is connected with the valve member 28, the outer end of the actuating arm being connected with a power delivery rod 30 of an associated electrically energizeable solenoid 31. A coiled spring 32 having one end bearing against a frame of the solenoid, and its other end bearing against an abutment pin 33 carried by the rod 30 acts to normally urge the valve member 28 to an open position with respect to the valve seat 27. However, upon energization of the solenoid 31, the valve member will be moved into closed position with respect to the seat 27.

During the flushing operation, according to my invention, the water level within the bowl is varied from a low water level 34, as determined by the line trap 21, to a raised or high water level 35, as determined by the action of a pressure switch 36. This switch is shown as comprising a diaphragm actuator 37 having an elongated inverted U-shaped tubular connection 38 with an inlet end 39 below the low water level 34, while the acute U-bend 40 is at a position near the high water level 35. This arrangement is used in order that air entrapped within the tube 38 will be utilized as the diaphragm actuating medium. The pressure switch includes a set of normally closed contacts 41 arranged to be operated to opened position when the predetermined high water level 35 is reached.

Electrically actuated timing means, as generally indicated at 42, are utilized to effect a cycle of sequential operations for flushing and cleaning the bowl. This timing means comprises a driving motor 43 which is operatively connected to a rotatable cam member 44 of generally circular configuration and having a chordal edge 45, which provides a dwell position for a cam follower 46. This cam follower is associated with an electric control switch 47 having normally open contact elements 48a and 48b. The follower 46 is arranged to actuate the switch contact elements from open position, as shown in FIG. 2, to a closed position when the cam 44 is rotated out of the dwell position shown. Manually operable actuator means 49 also provides for actuation of the contacts of switch 47 to closed position. The manual actuator is shown as comprising a rod member 50 which is supported for vertical movement within the wall structure 12. The innermost end of the rod member 50 bears against the contact element 48b, while the outermost end projects above the wall structure 12 and is provided with an actuating button 51 which may be depressed in order to close the contact elements of switch 47 to start the flushing cycle, when desired.

The operation will now be briefly described. Normally, the control components will be as shown in FIG. 2, the water level in the receptacle 14 being at the level 34. When it is desired to flush the toilet, the actuating button 51 is depressed, whereupon the contacts of switch 47 are closed to connect the terminals of the motor 43 with an electric source as indicated at 52. The motor begins to operate and drive the cam 44 so that the follower 46 will leave the dwell position 45 and be actuated to a position which will maintain the switch contacts in closed position.

Simultaneously, with the energization of the motor 43, the first valve 20 will be energized and motivated to an open position which permits flow of flushing water from the water supply connection 18 into the toilet receptacle 14.

The solenoid 31 will be energized through the closed contacts 41 of the pressure switch 36. Energization of the solenoid 31 closes the valve member 28, so as to cut off the outlet from the bowl receptacle 14, thus permitting the water in the receptacle to increase. As the water level approaches the level indicated at 35, the increased water pressure in the bowl will act upon the entrapped air within the tubular connection 38, in a manner to open the contacts 41, when the water level reaches the indicated level 35. Opening of the contacts 41 will interrupt the energizing circuit of solenoid 31. The valve member 28 is then actuated to open position under the action of coiled spring 32, thus permitting water to flow from the receptacle 14 and flush the contents of the bowl into drain line 22 and reestablish the water level 34.

The movement of the cam 44 of the timing means 42 determines the period in which the contacts of switch 47 remain closed. Subsequent to initiating the flushing operation, the cam 44 will move to a position wherein the follower will be positioned on the dwell part 45 of the cam just prior to the re-closing of the contacts 41, at which position the contacts of switch 47 will be opened to deenergize and stop the operation of the motor, and at the same time deenergize the solenoid 31 and the valve 20 to permit it to move to its normally closed position in which the supply of water to the bowl is shut off. The component parts of the control will now again be restored to the positions as shown in FIG. 2 pending the initiation of another flushing operation cycle.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extent indicated in the appended claims.

I claim:

1. In an electric flushing toilet bowl having a top rim opening and a bottom outlet connection with a drain line trap, the improvement comprising:

a. means for admitting a flushing fluid to the bowl adjacent the top rim opening, said means having a connection with a fluid source;

b. normally closed first valve means for controlling said fluid source connection;

c. normally open second valve means for controlling the outlet connection of said bowl;

d. manually operable switching means for initiating a flushing operation; and e. means for controlling actuation of said first and second valve means, including electric timing means having an energizing circuit controlled by said switching means and being energizable in response to the operation of said switching means, for effecting a cycle of sequential operations as follows:

1. to open said first valve means and close the second valve means so as to provide a raised fluid level in said bowl, 2. to open said second valve means in response to the raised fluid level in said bowl so as to utilize the fluid at the raised fluid level in the bowl for flushing the bowl, and 3. after a time interval close the first valve means.

2. The improvement according to claim 1, wherein the means to open said second valve means are fluid pressure responsive.

3. In combination:

a. a toilet bowl structure having a top rim opening and a bottom outlet connection;

b. a line trap connected with said outlet connection;

c. a bowl flushing mechanism including:

1. an outlet control valve in said trap having opened and closed positions with respect to flow through said outlet connection, 2. means operable to supply a predetermined quantity of water to said bowl, when said outlet control valve is in closed position, to raise the normal pool water level in said bowl and impound a volume of water for flushing, whereby upon movement of said outlet control valve to opened position the impounded water will be permitted to flow through the outlet connection and flush the bowl; and d. said trap being of inverted U-shaped configuration and said valve being in the downstream leg of the trap, and said trap being so positioned that, with the valve opened, a low level pool of water will be formed in the bowl.

4. In combination:

a. a toilet bowl structure having a top rim opening and a bottom outlet connection;

b. a line trap connected with said outlet connection; and c. a bowl flushing mechanism including:

1. an outlet control valve in said trap having opened and closed positions with respect to flow through said outlet connection, said outlet valve having means normally urging said valve towards an opened position and said means being electrically energizable for actuation to a closed position, 2. means operable to supply a predetermined quantity of water to said bowl, when said outlet control valve is in closed position, to raise the normal pool water level in said bowl and impound a volume of water for flushing, whereby upon movement of said outlet control valve to opened position the impounded water will be permitted to flow through the outlet connection and flush the bowl, 3. a control circuit for energizing said outlet control valve, and 4. Switching means having normally closed contacts in said control circuit, said switching means being responsive to a raised water level of said pool and being operative to open its contacts so as to deenergize said outlet control valve and permit its movement to opened position.

5. The combination according to claim 4, wherein said switching means are fluid pressure responsive.

6. The combination according to claim 4, wherein said water supply means includes an electric inlet valve; and including electric timing means having contacts operable to energize and deenergize said outlet control valve and said electric inlet valve.

7. The combination according to claim 6, wherein the contacts of said timing means are normally open, and in which cam means are operable to close said timing means contacts for a predetermined time interval.

8. The combination according to claim 7, wherein said timing means includes an electric driving motor having an energizing circuit controlld by said timing means contacts, and including manually operable means for initially closing said timing means contacts to energize said motor.

* * * * *